US009657562B2

(12) United States Patent
Li et al.

(10) Patent No.: US 9,657,562 B2
(45) Date of Patent: May 23, 2017

(54) METHODS AND SYSTEMS FOR DOWNHOLE TEMPERATURE LOGGING

(71) Applicant: HALLIBURTON ENERGY SERVICES, INC., Houston, TX (US)

(72) Inventors: Peng Li, Houston, TX (US); Lianhe Guo, Tomball, TX (US); Wesley N. Ludwing, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/021,853

(22) PCT Filed: Jan. 28, 2015

(86) PCT No.: PCT/US2015/013377

§ 371 (c)(1),
(2) Date: Mar. 14, 2016

(87) PCT Pub. No.: WO2016/122504

PCT Pub. Date: Aug. 4, 2016

(65) Prior Publication Data

US 2016/0356147 A1 Dec. 8, 2016

(51) Int. Cl.

| | |
|---|---|
| ***G01K 11/00*** | (2006.01) |
| ***G01K 11/06*** | (2006.01) |
| ***G01K 5/48*** | (2006.01) |
| ***G01K 5/56*** | (2006.01) |
| ***G01K 3/12*** | (2006.01) |
| ***E21B 47/06*** | (2012.01) |

(Continued)

(52) U.S. Cl.

CPC ..... *E21B 47/065* (2013.01); *E21B 17/20* (2013.01); *E21B 47/12* (2013.01)

(58) Field of Classification Search

CPC G01K 13/00; G01K 5/00; G01K 5/04; G01K 3/10; G01K 3/12; G01K 11/00; G01K 11/06; G01K 5/56; G01K 5/48; G01N 25/00

USPC ... 374/102, 45, 55, 136, 205, 187, 160, 141; 702/6

See application file for complete search history.

(56) References Cited

U.S. PATENT DOCUMENTS 3,965,741 A * 6/1976 Wachtell ..... G01K 11/06 116/217

4,033,186 A 7/1977 Bresie (Continued)

FOREIGN PATENT DOCUMENTS

WO 2006/015277 2/2006

OTHER PUBLICATIONS

PCT International Search Report and Written Opinion, dated Oct. 19, 2015 "Methods and Systems for Downhole Temperature Logging," Appln No. PCT/US2015/013377 filed Jan. 28, 2015, 11 pgs.

*Primary Examiner* — Gail Kaplan Verbitsky

(74) *Attorney, Agent, or Firm* — Iselin Law PLLC; Scott Richardson

(57) ABSTRACT

A downhole temperature logging method includes deploying a temperature logging device into a borehole, the temperature logging device having a mechanical drive and at least one shape memory alloy (SMA) unit. The method also includes deforming the SMA unit in response to a temperature or temperature range, wherein the deforming causes marks to a medium. The method also includes retrieving the medium and analyzing the marks.

20 Claims, 7 Drawing Sheets

(51) Int. Cl.
*E21B 17/20* (2006.01)
*E21B 47/12* (2012.01)

(56) References Cited

U.S. PATENT DOCUMENTS

| | | | | |
|---|---|---|---|---|
| 4,999,615 | A * | 3/1991 | Toupin | G01K 11/06 116/204 |
| 5,136,525 | A | 8/1992 | Cloud | |
| 6,893,155 | B2 * | 5/2005 | Kaiser | G01K 5/70 116/216 |
| 7,048,730 | B2 * | 5/2006 | Petrakis | G01K 5/483 222/54 |
| 7,598,898 | B1 * | 10/2009 | Funk | G01S 7/003 342/175 |
| 2002/0067754 | A1 * | 6/2002 | Werneth | A61B 5/01 374/179 |
| 2004/0161015 | A1 * | 8/2004 | Kaiser | G01K 5/70 374/187 |
| 2004/0194970 | A1 | 10/2004 | Eatwell et al. | |
| 2005/0105587 | A1 * | 5/2005 | Shahinpoor | G01K 5/483 374/205 |
| 2006/0176353 | A1 | 8/2006 | Gidon | |
| 2006/0207495 | A1 | 9/2006 | Petrakis | |
| 2009/0041085 | A1 * | 2/2009 | Petrakis | A61M 31/002 374/187 |
| 2009/0071717 | A1 * | 3/2009 | Gissler | G01B 7/003 175/45 |
| 2009/0151924 | A1 | 6/2009 | Lake | |
| 2010/0163250 | A1 | 7/2010 | Schultz et al. | |
| 2011/0024653 | A1 | 2/2011 | Huber et al. | |
| 2011/0232562 | A1 | 9/2011 | Koehler et al. | |
| 2014/0373619 | A1 * | 12/2014 | Slay | E21B 47/14 73/152.58 |
| 2015/0361754 | A1 * | 12/2015 | Kocurek | E21B 33/0355 60/327 |

* cited by examiner

METHODS AND SYSTEMS FOR DOWNHOLE TEMPERATURE LOGGING

BACKGROUND

In the oil and gas well drilling industry, downhole temperature logs are useful for formation evaluation and for interpreting downhole conditions during drilling operations, well completion, and/or reservoir and production monitoring. One option for collecting a downhole temperature log involves deploying sensors that rely on electrical power to sense temperature and/or to convey a temperature reading to a storage media downhole or at earth's surface. Another option for collecting a downhole temperature log involves deploying a fiber optic cable (distributed temperature sensing). In a drilling environment, maintaining a continuous electrical or optical transmission line is problematic due to issues such as the segmented manner in which drill strings are formed, the drill string twisting and contacting the borehole wall, and space constraints. While use of a portable electrical power source (e.g., batteries) could enable collection of a downhole temperature log without a continuous electrical or optical transmission line, the high temperatures in the downhole environment often degrade or prevent use of a portable electrical power source.

BRIEF DESCRIPTION OF THE DRAWINGS

Accordingly, there are disclosed in the drawings and the following description methods and systems for downhole temperature logging that do not require portable electrical power or continuous communication to the surface for power or data storage. In the drawings.

Figure 1:
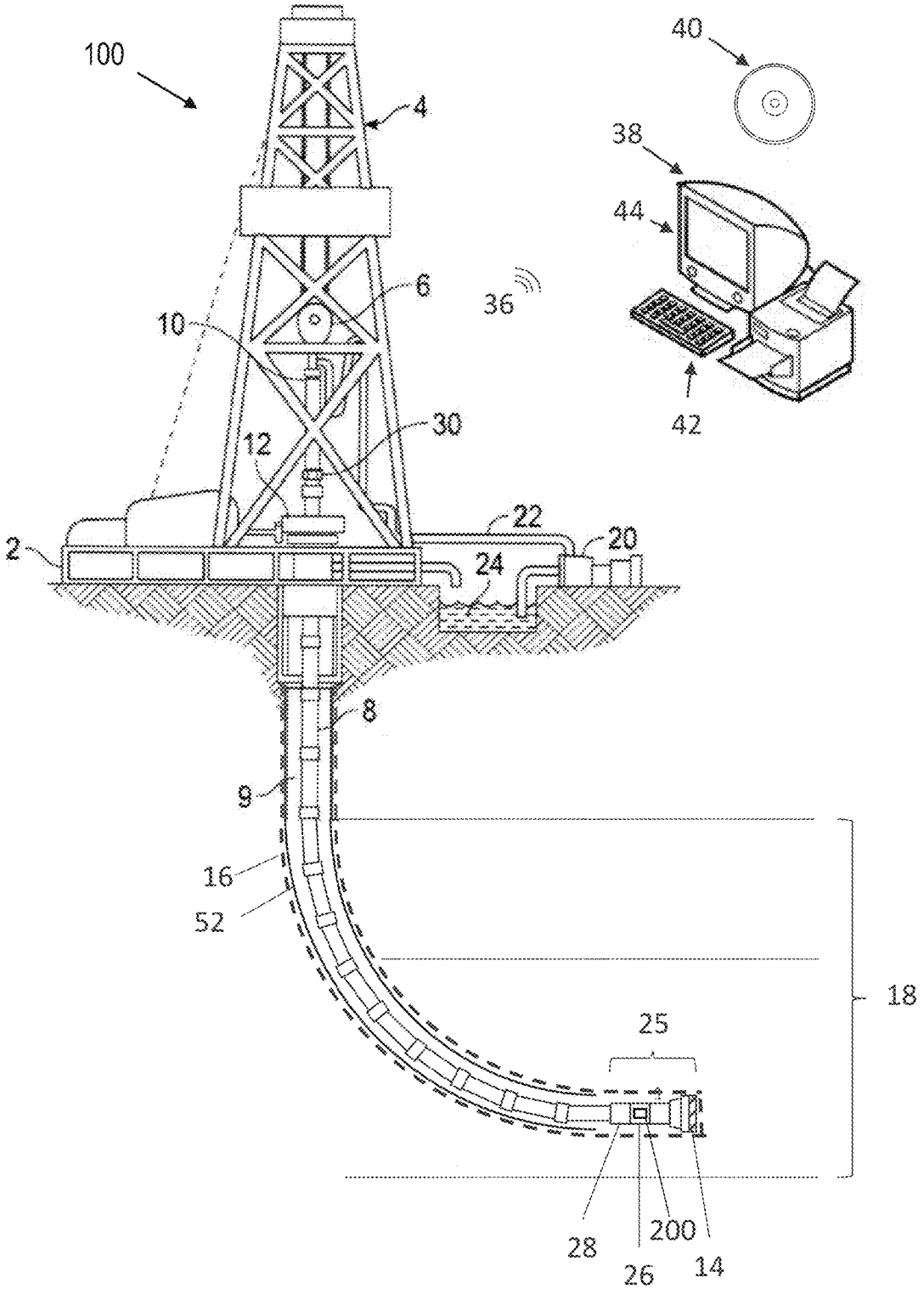
FIG. 1 is a schematic diagram showing an exemplary drilling environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are methods and system for downhole temperature logging employing a mechanical drive and shape memory alloy. As used herein, "shape memory alloys" (or "SMAs") refer to materials that deform from a first shape to a second shape in response to being heated to a particular temperature or temperature range. In at least some embodiments, the first shape corresponds to an altered or trained state for the SMA material, while the second shape corresponds to an original or default state for the SMA material. As an example, SMA material can be deformed in a low temperature phase and can recover its original shape by a reverse transformation upon being heated to at least a critical temperature. When the SMA material deforms from the first shape to the second shape, any movement of the SMA material can generate sufficient force to actuate or move other objects in contact with the SMA material. The force applied by SMA material during deformation may correspond to a contraction (a pull) or an expansion (a push). It should be appreciated that different SMA materials can support different shapes, different amounts of deformation, different one-way or two-way memory effects, etc. Example SMA materials include wires made from Flexinol, NiTi, CuSn, InTi, and MnCu. For more information regarding SMAs, reference may be had to D. C. Lagoudas, *Shape Memory Alloys*, ISBN: 978-0-387-47684-1 or 978-0-387-47685-8, pages 1-16 (2008).

An example downhole temperature logging method includes deploying a temperature logging device into a borehole, where the temperature logging device includes a mechanical drive and at least one SMA unit. The method also includes deforming the at least one SMA unit in response to a temperature or temperature range, where deforming the at least one SMA unit results in marks to a medium. The method also includes retrieving the medium from the borehole and analyzing the marks. Meanwhile, an example downhole temperature logging system includes at least one SMA unit and a medium that receives marks due to deformation of the at least one SMA unit in response to a temperature or temperature range. The system also includes a mechanical drive that moves the medium in relation to the at least one SMA unit as a function of time or measured depth. Various downhole temperature logging options involving SMA units, a mechanical drive, and a medium for recording temperature as a function of time or measured depth are disclosed herein. Embodiments that log temperature values without time or measured depth information are also contemplated.

The disclosed downhole temperature logging methods and systems are best understood when described in an illustrative usage context. FIG. 1 shows an illustrative drilling environment 100 in which downhole temperature logging may be performed as described herein. In FIG. 1, a drilling platform 2 supports a derrick 4 having a traveling block 6 for raising and lowering a drill string 8. A drill string kelly 10 supports the rest of the drill string 8 as it is lowered through a rotary table 12. The rotary table 12 rotates the drill string 8, thereby turning a drill bit 14. Additionally or alternatively, rotation of the drill bit 14 is controlled using a mud motor or other rotation mechanism. As the drill bit 14 rotates, it creates a borehole 16 (represented using dashed lines) that passes through various formations 18. A pump 20 circulates drilling fluid through a feed pipe 22 to the drill string kelly 10, downhole through the interior of drill string 8, through orifices in the drill bit 14, back to the surface via the annulus 9 around the drill string 8, and into a retention pit 24. The drilling fluid transports cuttings from the borehole 16 into the retention pit 24 and aids in maintaining the integrity of the borehole 16.

In at least some embodiments, the drill bit 14 is just one piece of a bottom-hole assembly (BHA) 25 that includes one or more drill collars 26, logging tool 28, and a temperature logging device 200. The drill collars 26 are thick-walled steel pipe sections that provide weight and rigidity for the drilling process. The logging tool 28 (which may be built into one of the drill collars) gathers measurements of various drilling or formation parameters. The temperature logging device 200 collects temperature values as a function of time or measured position using SMA material and a mechanical drive as described herein. The measurements collected by the logging tool 28 and/or the temperature logging device 200 may eventually be plotted or displayed in a user-friendly format and used for analysis of downhole conditions during drilling operations, well completion planning, reservoir and production monitoring, drilling performance, and/or formation properties While temperature measurements of the temperature logging device 200 are intended to be retrieved once the BHA 25 is removed from the borehole (to access the recording medium used by the temperature logging device 200), it should be appreciated that other measurements from the logging tool 28 can be acquired by a telemetry sub (e.g., integrated with logging tool 28) to be stored in internal memory and/or communicated to the surface via a communications link. Mud pulse telemetry is one common technique for providing a communications link for transferring logging measurements to a surface receiver 30 and for receiving commands from the surface, but other telemetry techniques can also be used.

The telemetry signals are supplied via a wired or wireless communications link 36 to a computer 38 or some other form of a data processing device. Computer 38 operates in accordance with software (which may be stored on information storage media 40) and user input via an input device 42 to process and decode the received signals. The resulting telemetry data may be further analyzed and processed by the computer 38 to generate a display of useful information on a computer monitor 44 or some other form of a display device including a tablet computer.

In at least some embodiments, temperature measurements collected by the temperature logging device 200 can be displayed via computer 38 or some other form of a data processing device after the recording medium is retrieved and its marks analyzed. As an example, images of a marked recording medium may enable recovery of temperature values as a function of time or position. Alternatively, the marks on the medium may be scanned using a custom scanner to extract information regarding the marks without use of images. In either case, the features of the marks (e.g., position, length, intensity, depth) can be correlated with temperature values as a function of time or measured depth. Once temperature values as a function of time or measured depth are obtained from analysis of marks on the medium, the temperature values can be plotted or otherwise displayed via computer 38. Alternatively, the temperature values or logs may be printed and/or stored for later analysis.

Figure 2:
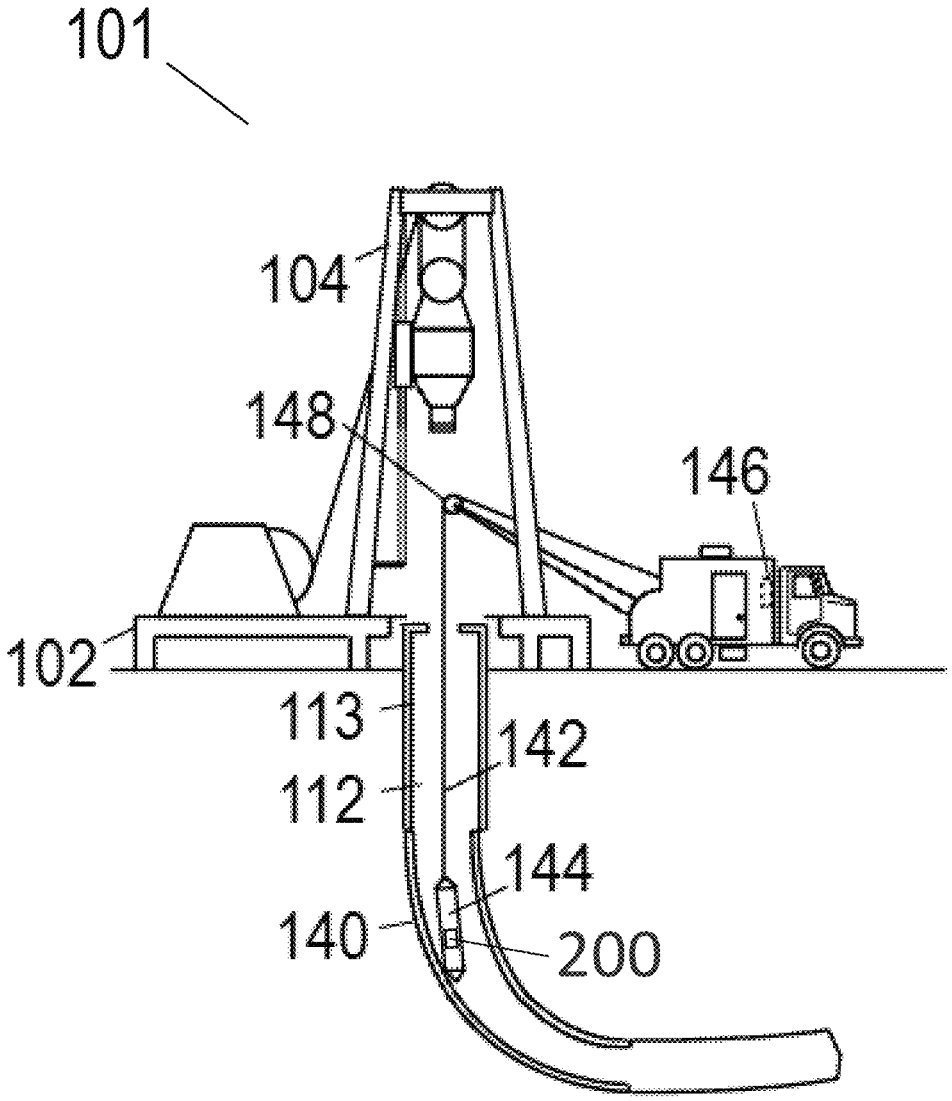
FIG. 2 is a schematic diagram showing an illustrative wireline logging environment.

FIG. 2 shows an illustrative wireline logging environment 101 that may represent the environment of FIG. 1 with the drill string 8 removed from the borehole 16 (after drilling string trip-out) or another similar environment. In the wireline logging environment 101, a first casing section 113 and a second casing section 140 have been installed in a borehole 112. Further, a wireline cable 142 suspends a tool string 144 (or sonde) in the borehole 112 and couples the tool string 144 to a logging facility or vehicle 146, which may include one or more computer systems. A pulley 148 (shown to be part of a wireline truck boom, but alternatively affixed to a platform 102 with a rig 104) enables the tool string 144 to be lowered and raised along the borehole 112 at a controlled speed. In alternative embodiments, tool string 144 could be deployed downhole using coiled tubing, slickline, or any other appropriate conveyance instead of a wireline.

In at least some embodiments, the wireline cable 142 (or alternative conveyance) includes electrical and/or optical conductors for transporting measurement data to the logging facility or vehicle 146 and optionally conveying electrical power to the tool string 144. Further, in at least some embodiments, the tool string 144 may have pads and/or centralizing members to maintain the tool centered in the borehole 112 during logging operations. The tool string 144 may acquire various types of data related to formation properties or downhole conditions. The logging facility or vehicle 146 receives the measurements collected by the tool string 144 (e.g., via a wired or wireless link) and a related computer system stores, processes, and/or displays the measurements or related information.

In at least some embodiments, the tool string 144 includes the temperature logging device 200 employing SMA units, a recording medium, and a mechanical drive to log downhole temperatures. As previously discussed, temperature measurements collected by the temperature logging device 200 in tool string 114 can be displayed via computer 38 or some other form of a data processing device after the related recording medium is retrieved and its marks analyzed.

Although FIGS. 1 and 2 show certain rig sites and/or drill rigs, persons having ordinary skill in the art will be able to apply the teachings of this disclosure to many different drilling environments. Examples include floating, jack-up, or other off-shore drilling platforms.

Figure 3:
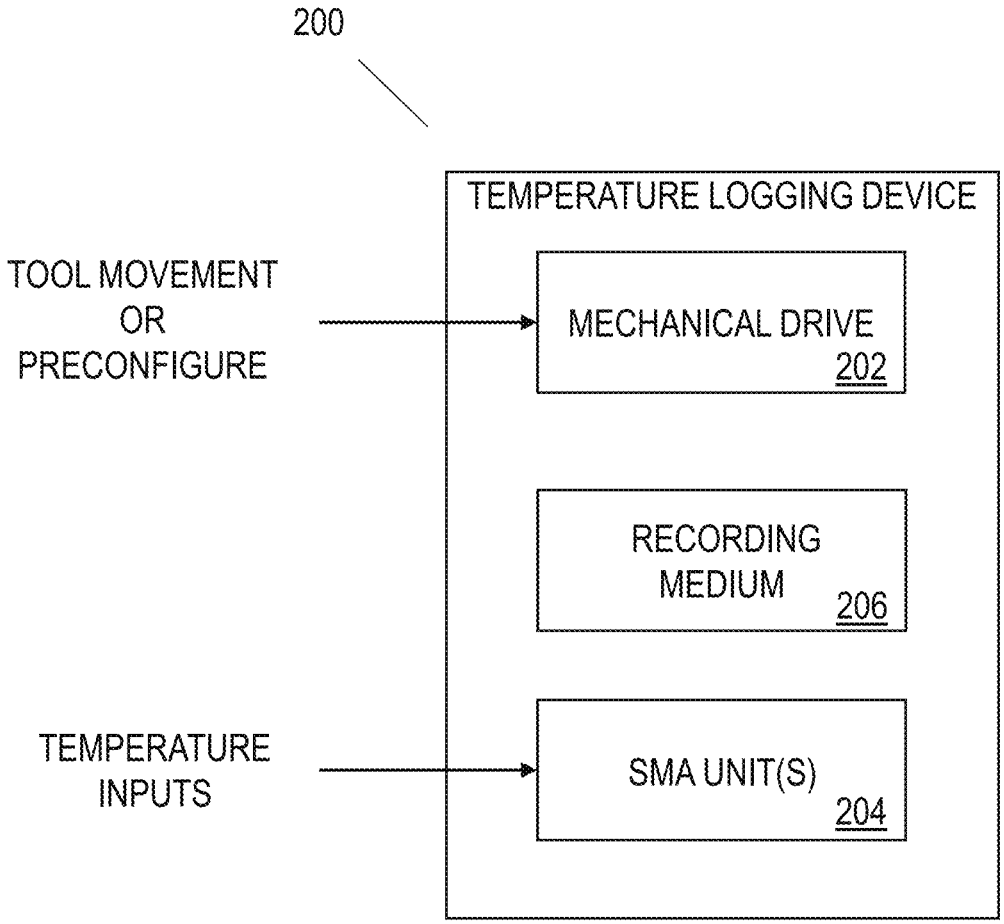
FIG. 3 is a block diagram showing an illustrative temperature logging device.

FIG. 3 is a block diagram showing the temperature logging device 200. As shown, the temperature logging device 200 includes a mechanical drive 202, at least one SMA unit(s) 204, and a recording medium 206. In at least some embodiments, the mechanical drive 202 comprises a hand-wound clock component that can be wound up at earth's surface by an operator prior to downhole temperature logging operations. Additionally or alternatively, the mechanical drive 202 comprises a self-winding clock component that winds itself during downhole temperature logging operations. Additionally or alternatively, a separate winding element may be used to wind the mechanical drive 202 during downhole temperature logging operations. For example, movements of a winding element in response to a drill string or tool string turning, in response to side-to-side motion, or in response to contact with another surface may serve to wind up the mechanical drive 202 during downhole temperature logging operations. In at least some embodiments, the separate winding element moves as a function of measured depth. By coupling a winding element that moves as a function of measured depth to the mechanical drive 202, the operation of the mechanical drive 202 can likewise vary as a function of measured depth.

Each SMA unit 204 includes SMA material that deforms in response to a particular temperature or temperature range. Further, each SMA unit 204 may contact the recording medium 206 in a manner that varies depending on the state of the SMA material. For example, when SMA material of the SMA unit 204 has a first shape, the SMA unit 204 may contact the recording medium 206 with a first compression force. However, when SMA material of the SMA unit 204 has a second shape, the SMA unit 204 may contact the recording medium 206 with a second compression force that is different than the first compression force (stronger or weaker). The intensity of marks made to the recording medium 206 will therefore vary as function of temperature depending on a particular temperature or temperature range at which SMA material in SMA units 204 deforms.

The recording medium 206 may include any material that serves to receive marks from the SMA units 204. The recording medium 206 may be sturdy enough to survive use in the harsh downhole environment, and malleable enough to enable variance of the marks made by the SMA units 204 in response to the variable deformation of the SMA material as a function of temperature. In at least some embodiments, the recording medium 206 corresponds to a metallic foil or plate. The shape and size of the recording medium 206 may vary depending on the amount of space available in a BHA 25 or temperature logging device 200. Further, the curvature or wrapping arrangement of the recording medium 206 may vary as desired.

In order to collect temperature measurements as a function of time or measured depth, the mechanical drive 202 causes the position of each SMA unit 204 relative to the recording medium 206 to vary as a function of time or measured depth. For example, each SMA unit 204 may be coupled to a moving element of the mechanical drive 202, where the moving element moves each SMA unit 204 as a function of time or measured depth while the recording medium 206 is stationary (at least relative to the mechanical drive 202). As another example, the recording medium 206 may be coupled to a moving element of the mechanical drive 202, where the moving element moves the recording medium 206 as a function of time or measured depth while each SMA unit 204 is stationary (at least relative to the mechanical drive). The movement of each SMA unit 204 or the recording medium 206 due to the moving element of the mechanical drive 202 may correspond to a linear and/or angular motion.

Figure 4A:
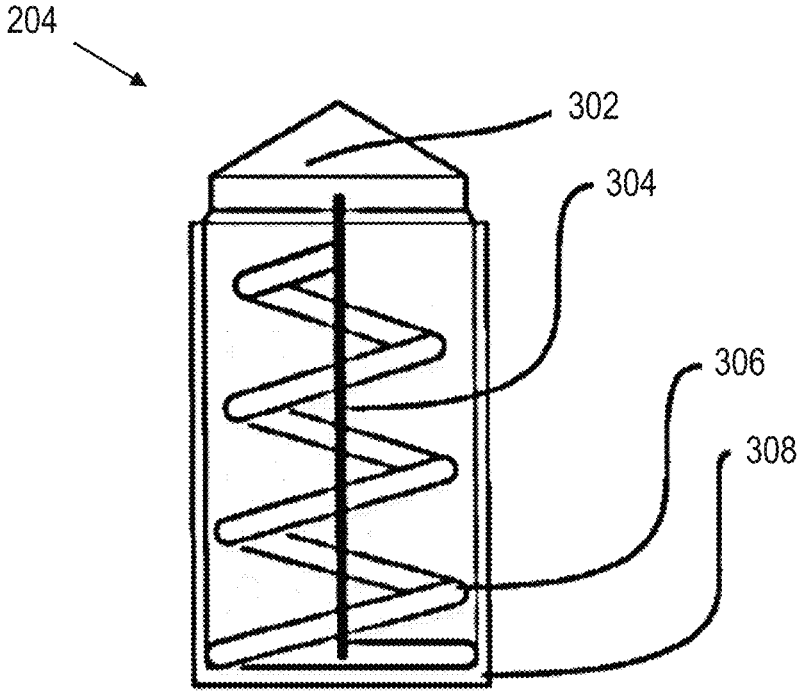
FIG. 4A is a cross-sectional view showing an illustrative shape memory alloy (SMA) unit.

FIG. 4A is a cross-sectional view of the illustrative SMA unit 204 with SMA material 304. In FIG. 4A, SMA material 304 corresponds to a wire that, upon deformation (contraction or extension), moves contact point 302 relative to a medium (e.g., recording medium 206) or varies a tension of the contact point 302 against a medium. The SMA unit 204 also includes a spring 306 and a housing 308. The SMA material 304 may be fixably connected to the housing 308 and the contact point 302, while the spring 306 maintains the contact point 302 and SMA material 304 at a default tension. The fit or friction between the contact point 302 and the housing 308 may also determine the amount of tension applied to the contact point 302 and the SMA material 304 by the spring 306.

The SMA material 304 is selected based on a desired temperature range of interest, defined by two temperature values, $A_s$ (austentite start temperature) and $A_f$ (austentite finish temperature). When the ambient temperature of the SMA material increases to $A_s$, a phase transformation begins and the SMA material 304 contracts or extends, depending on the materials selected. Maximum displacement occurs at a temperature of at least $A_f$. In at least some embodiments, the reverse effect occurs during cooling with the SMA material 304 extending or contracting back to its original shape. During contraction and extension of the SMA material 304, the effects of hysteresis are present (e.g., there are uneven deformation characteristics of the SMA material 304 depending on whether the temperature is increasing from $A_s$ to $A_f$ or decreasing from $A_f$ to $A_s$).

In at least some embodiments, the SMA material 304 corresponds to a wire configured to deform by extending when a temperature between $A_s$ and $A_f$ is reached. In such case, as the ambient temperature increases from $A_s$ to $A_f$, the contact point 302 would move away from the housing 308 (i.e., the total length of the SMA unit 204 increases). By careful arrangement of the SMA unit 204 relative to the recording medium 206, movement of the contact point 302 will result in new marks or modified marks on the recording medium 206. In the scenario where the SMA material 304 is configured to extend in response to an increase in temperature from $A_s$ to $A_f$, increases in mark intensity would be expected as temperature increases from $A_s$ to $A_f$.

In other embodiments, the SMA material 304 corresponds to a wire configured to deform by contracting when a temperature between $A_s$ to $A_f$ is reached. In such case, as the ambient temperature increases from $A_s$ to $A_f$, the contact point 302 would move towards the housing 308 (i.e., the total length of the SMA unit 204 decreases). By careful arrangement of the SMA unit 204 relative to the recording medium 206, movement of the contact point 302 will result in an absence of marks or in modified marks on the recording medium 206. In the scenario where the SMA material 304 is configured to contract in response to an increase in temperature from $A_s$ to $A_f$, decreases in mark intensity would be expected as temperature increases from $A_s$ to $A_f$.

The SMA unit 204 or recording medium 206 may also move relative to each other as a function of time or measured depth. As long as the movement of the SMA unit 204 in response to temperature is known, and as long as the movement of the SMA unit 204 relative to the recording medium 206 as a function of time or measured depth is known, temperature as a function of time or measured depth can be tracked by analysis of marks applied to the recording medium 206.

In different embodiments, changes in temperature may result in the contact point 302 being moved closer to or further away from the recording medium 206. Such movement may result in new marks (or absence of marks) and/or may result in variance with regard to the intensity of the marks. Meanwhile, changes in time or measured depth result in the contact point 302 marking the recording medium 206 at a different spot (e.g., changes in time or measured depth result is a sideways movement of the contact point 302 or recording medium 206 relative to each other). In different embodiments, the spring 306 provides tension to enhance or counter movement of the contact point 302 relative to a default position as a result of the SMA material 304 deforming. In at least some embodiments, the spring 306 is selected with a particular stiffness or is otherwise tuned to minimize the hysteresis of the SMA material 304 (e.g., the amount of movement of the contact point 302 as temperature increases from $A_s$ to $A_f$ is preferably the same amount and is opposite in direction as the amount of movement of the contact point 302 as temperature decreases from $A_f$ to $A_s$). The arrangement represented in FIG. 4A is only an example. It should be appreciated that other SMA unit arrangements could vary.

Figure 4B:
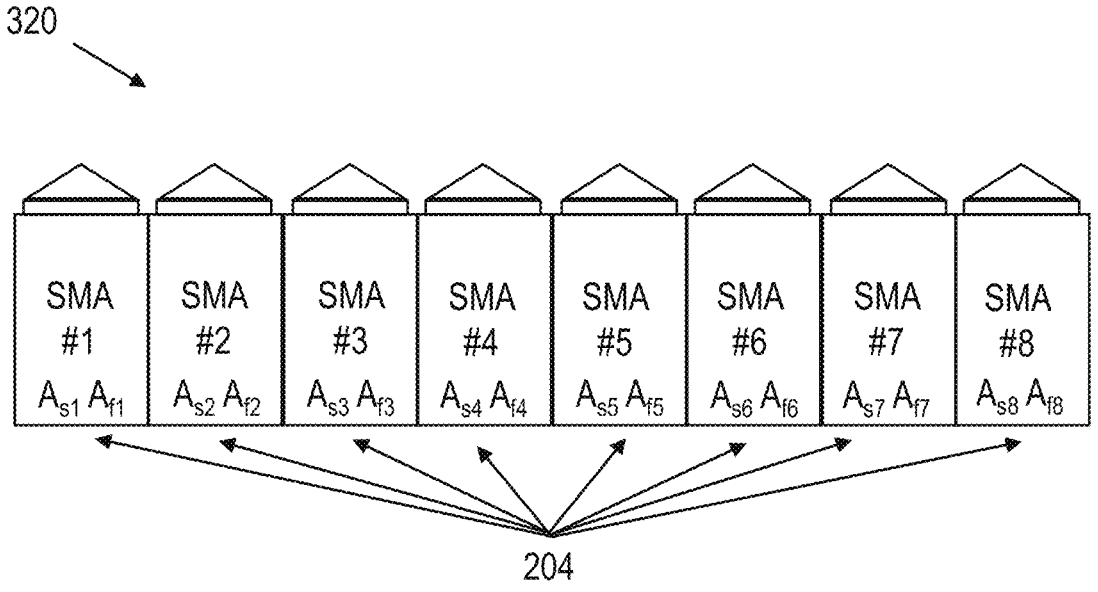
FIG. 4B is a simplified view showing an illustrative set of SMA units.

FIG. 4B is a schematic diagram of a set 320 of SMA units 204, each SMA unit 204 as described in FIG. 3A. For the set 320, there are eight SMA units 204 arranged side-by-side. In an alternative set arrangement, the SMA units 204 could be spaced apart and/or angled relative to each other (depending on the medium used). For different sets of SMA units 204, the SMA units 204 could be positioned along a line (as shown), along a curve, in different planes, etc. The different SMA units 204 represented in FIG. 3B are designed of respond to different temperature ranges as defined by values $A_{sn}$ and $A_{fn}$, "n" corresponding to the SMA unit in question (#1 through 48 in this example). Accordingly, the set 320 of SMA units 204 will react to eight different temperature ranges, resulting in corresponding marks to the recording medium 206.

Figure 5A:
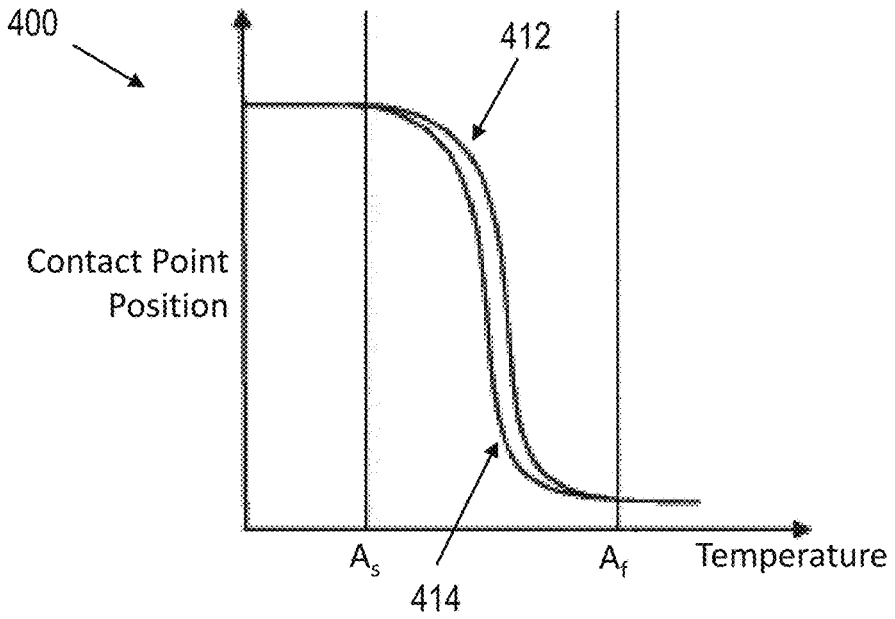
FIG. 5A is a chart representing the contact point position for an SMA unit as a function of temperature.

FIG. 5A shows a graph 400 representing contact point position as a function of temperature for an SMA unit. For all temperatures lower than or equal to $A_s$, the contact point position is approximately fixed at a first value (P1). Meanwhile, for all temperatures higher than or equal to $A_f$, the contact position is approximately fixed at a second value (P2). Between $A_s$ and $A_f$, the contact point position varies as a function of temperature. More specifically, curve 412 corresponds to variance in the contact point position when temperatures are increasing from $A_s$ to $A_f$, while curve 414 corresponds to variance in the contact point position when temperatures are decreasing from $A_f$ to $A_s$. The difference between curves 412 and 414 represents hysteresis phenomena of the SMA material used.

In at least some embodiments, hysteresis in SMA materials is accounted for by using multiple SMA units with narrow temperature ranges. Within a narrow temperature range, hysteresis effects may be smaller and perhaps negligible. In either case, interpreting markings on the recording medium 206 can be simplified. Also, as previously mentioned, the spring arrangement used for an SMA unit 204 may be selected or tuned to minimize hysteresis effects. Further, to the extent hysteresis behavior is predictable it can be accounted for regardless of the temperature range.

Figure 5B:
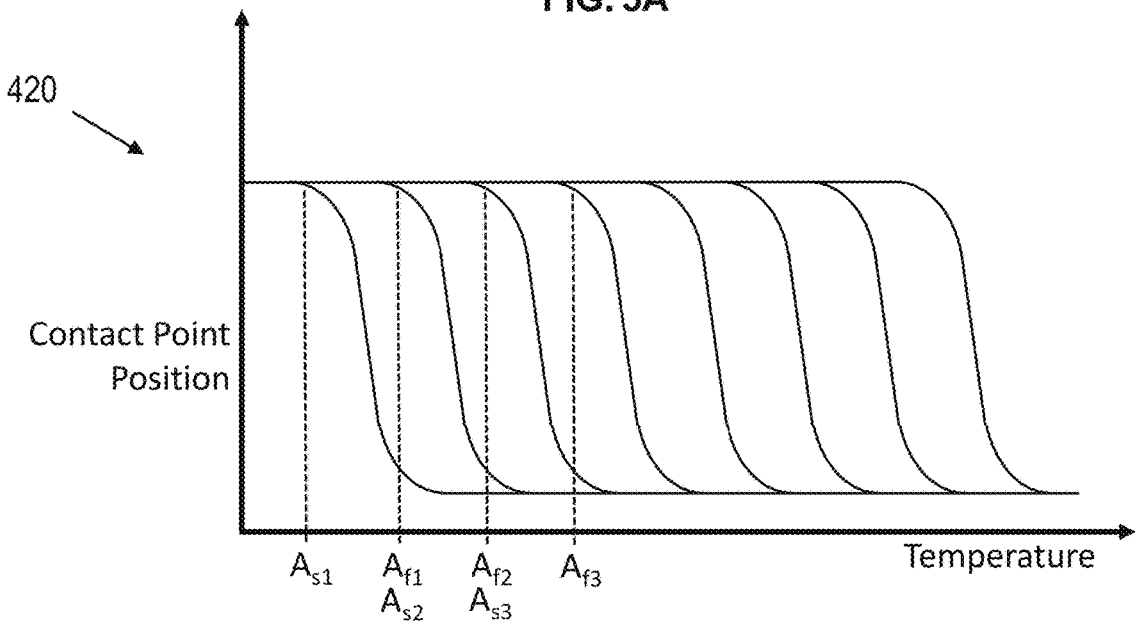
FIG. 5B is a chart representing the contact point positions for a set of SMA unit as a function of temperature.

FIG. 5B is a graph 420 representing contact point position as a function of temperature for a set of SMA units (e.g., set 320), where each SMA unit has different values for $A_s$ and $A_f$ ($A_{s1}$ and $A_{f1}$ correspond to a first SMA unit, $A_{s2}$ and $A_{f2}$ correspond to a first SMA unit, and so on). As desired, the temperature sensitivity ranges for adjacent SMA units can partially overlap as shown, or be spread out. While not shown in FIG. 5B, it should be appreciated that one SMA unit in a set may have a narrow temperature sensitivity range while another SMA unit in the set may have a broader sensitivity range.

Figure 6:
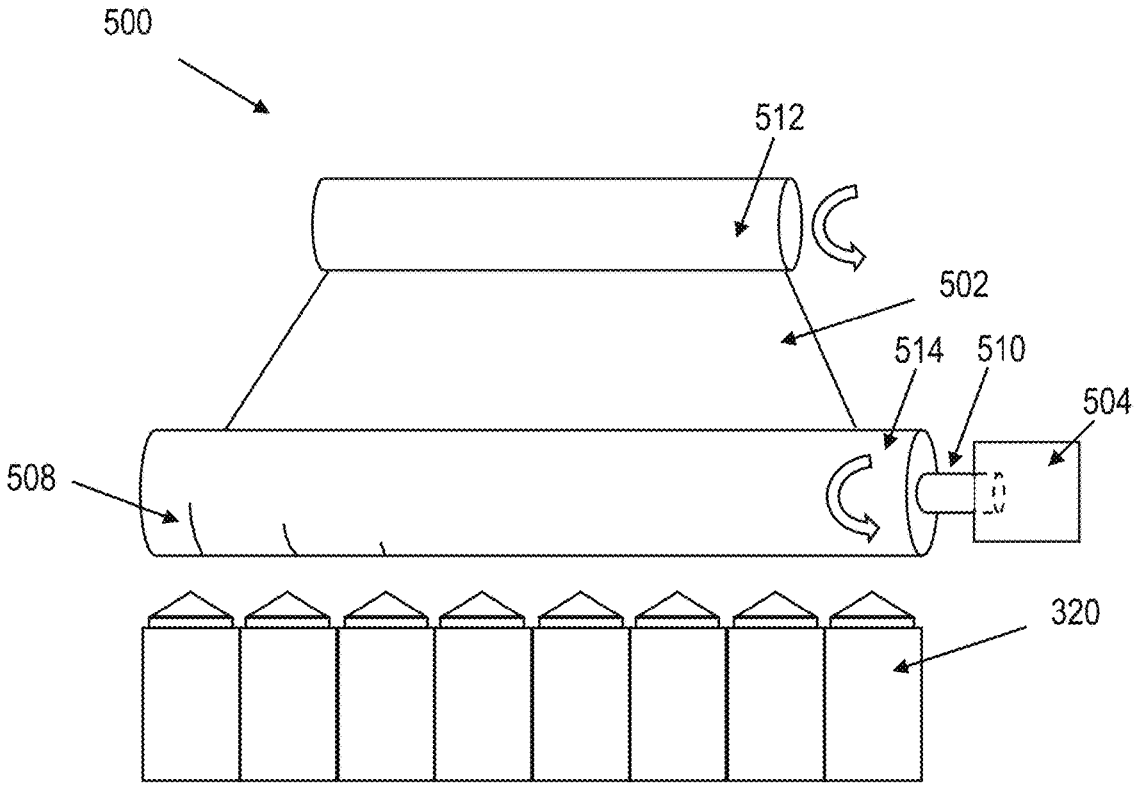
FIG. 6 is a schematic diagram showing operation of an illustrative temperature logging device.

FIG. 6 is a schematic diagram of an illustrative temperature logging device 500 corresponding to a version of the temperature logging device 200 discussed previously. The temperature logging device 500 includes a medium 502 (in the form of a scroll), a mechanical drive 504, a drive shaft 510 connecting the mechanical drive 504 to the medium 502, the set 320 of SMA units, a first axle 512, and a second axle 514 as described herein. During operation, the mechanical drive 504 turns the drive shaft 510 which is fixably attached to the second axle 514, causing the medium 502 to unwrap from around the first axle 512 while wrapping around the second axle 514. As the medium 502 moves, marks and/or perforations 508 are added to the medium 502 by one or more SMA units of the set 320. In at least some embodiments, the mechanical drive 504 causes the medium 502 to move as function of time or measured depth as described herein. In this manner, the marks applied to the medium 502 can be interpreted as having occurred at a particular time or at a particular measured depth.

The temperature logging device 500 shown in FIG. 6 is only an example. In different temperature logging device embodiments, the arrangement of SMA units, the medium, and the mechanical drive may vary. As needed, multiple mechanical drives may be used. Further, the size and orientation of the SMA units, the medium, and the mechanical drive may vary. Further, the manner in which SMA units or the medium move relative to each other may vary (sideways movement arrangements or angular movement arrangements are contemplated). For deploying the temperature logging device 500, the temperature logging device 500 would have components sized and arranged to fit within the dimensions of BHA 25 while allowing fluid to pass through the BHA 25. For deploying the temperature logging device 200 in a wireline logging environment 101 of FIG. 2 (or a coiled tubing logging scenario), the temperature logging device 200 would have components sized and arranged to fit within the dimensions of tool string 144.

In one contemplated embodiment, a temperature logging device omits the mechanical drive. In such a case, it is still possible to record particular temperatures values using different SMA units, but the timing or depth information will not be available without a mechanical drive. In yet another contemplated embodiment, the mechanical drive 504 may use some electrical energy (e.g., from a battery) to supplement the mechanical force available from winding a spring or other mechanical energy storage options.

Figure 7:
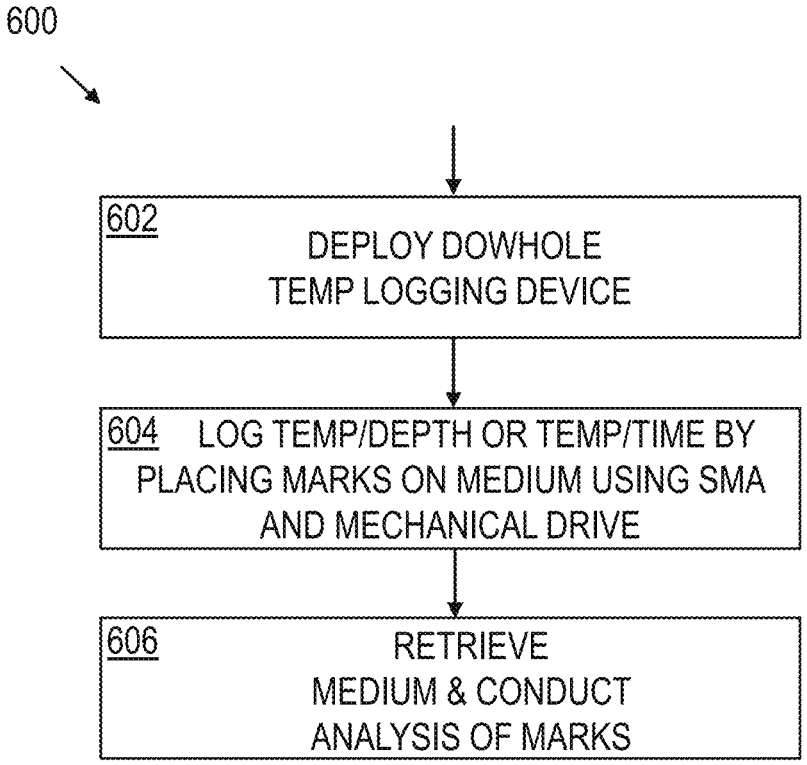
FIG. 7 is a block diagram showing a downhole temperature logging method.

FIG. 7 is a block diagram of a downhole temperature logging method 600. The method 600 includes deploying a temperature logging device downhole at block 602. As described herein, the temperature logging device may be part of a BHA or wireline tool string, and may have a mechanical drive, at least one SMA unit, and a recording medium. At block 604, temperature measurements are collected as a function of time or measured depth by applying marks to a medium as a result of SMA deformation and a mechanical drive. The mechanical drive has at least one moving element that moves as a function of time or measured position. By coupling the recording medium or SMA units to the moving element of the mechanical drive, a temperature log can be collected as a function of time or measured depth. At block 606, the medium is retrieved and the marks are analyzed. For example, the analysis of the marks at block 606 may result in a temperature log being displayed via a computer. Such temperature logs are useful for formation evaluation and for interpreting downhole conditions during drilling operations, well completion, and/or reservoir and production monitoring.

Embodiments disclosed herein include:

A: A downhole temperature logging method comprising deploying a temperature logging device into a borehole, said temperature logging device having a mechanical drive and at least one SMA unit. The method also comprises deforming the at least one SMA unit in response to a temperature or temperature range, wherein said deforming results in marks to a medium. The method also comprises retrieving the medium from the borehole and analyzing the marks.

B: A downhole temperature logging system that comprises at least one SMA unit. The system also comprises a medium that receives marks due to deformation of the at least one SMA unit in response to a temperature or temperature range. The system also comprises a mechanical drive that moves the medium in relation to the at least one SMA unit as a function of time or measured depth.

Each of embodiments A and B may have one or more of the following additional elements in any combination: Element 1: wherein the medium is a metal foil, and wherein deforming the at least one SMA unit causes marks on or through the metal foil. Element 2: further comprising scanning the marks and generating a temperature log based on the scanned marks. Element 3: wherein the medium is stationary in relation to the at least one SMA unit. Element 4: further comprising moving the medium in relation to the at least one SMA unit as a function of time using the mechanical drive. Element 5: further comprising moving the medium in relation to the at least one SMA unit as a function of measured depth using the mechanical drive. Element 6: further comprising winding the mechanical drive before deploying the temperature logging device. Element 7: further comprising winding the mechanical drive during deployment of the temperature logging device based on movement of the temperature logging device or another device coupled to the temperature logging device. Element 8: wherein deforming the at least one SMA unit in response to a temperature or temperature range comprises deforming a plurality of SMA units responsive to different temperature ranges. Element 9: wherein the temperature logging device is part of a BHA or wireline tool string. Element 10: wherein the temperature logging device is powered only by the mechanical drive. Element 11: wherein the mechanical drive comprises a hand-wound clock component. Element 12: wherein the mechanical drive comprises a self-winding clock component. Element 13: further comprising a winding element separate from the mechanical drive, the winding element being configured to wind the mechanical drive in response to being moved in a downhole environment. Element 14: wherein the medium is a metal foil. Element 15: wherein each SMA unit comprises a contact point, a spring, and SMA material. Element 16: wherein the spring causes the contact point to press against the medium, and wherein deformation of the SMA material as a function of temperature changes an amount of pressure applied by the contact point to the medium. Element 17: wherein the temperature logging device comprises a plurality of SMA units responsive to different temperatures or temperature ranges. Element 18: wherein the at least one SMA unit, the medium, and the mechanical drive are components of a temperature logging device included with a BHA or wireline tool string.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A downhole temperature logging method comprising:

deploying a temperature logging device into a borehole, said temperature logging device having a mechanical drive and at least one shape memory alloy (SMA) unit;

deforming the at least one SMA unit in response to a temperature or temperature range, wherein said deforming results in marks to a medium; and retrieving the medium from the borehole and analyzing the marks.

2. The method of claim 1, wherein the medium is a metal foil, and wherein deforming the at least one SMA unit causes marks on or through the metal foil.

3. The method of claim 1, further comprising scanning the marks and generating a temperature log based on the scanned marks.

4. The method of claim 1, wherein said medium is stationary in relation to the at least one SMA unit.

5. The method of claim 1, further comprising moving the medium in relation to the at least one SMA unit as a function of time using the mechanical drive.

6. The method of claim 1, further comprising using the mechanical drive to move the medium in relation to the at least one SMA unit as a function of the temperature logging device's position along the borehole.

7. The method of claim 1, further comprising winding the mechanical drive before said deploying.

8. The method of claim 7, further comprising winding the mechanical drive during said deploying based on movement of the temperature logging device or another device coupled to the temperature logging device.

9. The method of claim 1, wherein deforming the at least one SMA unit in response to a temperature or temperature range comprises deforming a plurality of SMA units responsive to different temperature ranges.

10. The method of claim 1, wherein the temperature logging device is part of a bottom hole assembly (BHA) or wireline tool string.

11. The method of claim 1, wherein the temperature logging device is powered only by the mechanical drive.

12. A downhole temperature logging device that comprises:

at least one shape memory alloy (SMA) unit;

a medium that receives marks due to deformation of the at least one SMA unit in response to a temperature or temperature range; and a mechanical drive that moves the medium in relation to the at least one SMA unit as a function of time or the temperature logging device's position along a borehole.

13. The device of claim 12, wherein the mechanical drive comprises a hand-wound clock component to provide said movement as a function of time.

14. The device of claim 12, wherein the mechanical drive comprises a self-winding clock component to provide said movement as a function of time.

15. The device of claim 12, further comprising a winding element configured to wind the mechanical drive in response to the temperature logging device's motion along the borehole.

16. The device of claim 12, wherein the medium is a metal foil.

17. The device of claim 12, wherein each SMA unit comprises a contact point, a spring, and SMA material.

18. The device of claim 12, wherein the temperature logging device comprises a plurality of SMA units responsive to different temperatures or temperature ranges.

19. The device of claim 18, wherein the spring causes the contact point to press against the medium, and wherein deformation of the SMA material as a function of temperature changes an amount of pressure applied by the contact point to the medium.

20. The device of claim 12, wherein the at least one SMA unit, the medium, and the mechanical drive are included with a bottom hole assembly (BHA) or wireline tool string.

* * * * *